US005666703A

United States Patent [19]

Walton et al.

[11] Patent Number: 5,666,703

[45] Date of Patent: Sep. 16, 1997

[54] APPARATUS FOR COMPRESSIVELY TREATING FLEXIBLE SHEET MATERIALS

[75] Inventors: Richard C. Walton, 10 W. Hill Pl., Boston, Mass. 02114; George E. Munchbach, Roslindale, Mass.

[73] Assignee: Richard C. Walton, Boston, Mass.

[21] Appl. No.: 495,556

[22] PCT Filed: Feb. 4, 1994

[86] PCT No.: PCT/US94/01285

§ 371 Date: Sep. 15, 1995

§ 102(e) Date: Sep. 15, 1995

[87] PCT Pub. No.: WO94/17991

PCT Pub. Date: Aug. 18, 1994

[51] Int. Cl.[6] ..... D06C 21/00; D06C 23/04

[52] U.S. Cl. ..... 26/18.6; 162/111; 162/281

[58] Field of Search ..... 26/18.5, 18.6, 26/21, 99; 28/155, 156; 162/111, 280, 281; 264/282, 283; 425/194, 328, 374

[56] References Cited

U.S. PATENT DOCUMENTS

| | | | |
|---|---|---|---|
| 3,122,767 | 3/1964 | Carvill . | |
| 3,416,192 | 12/1968 | Packard . | |
| 3,427,376 | 2/1969 | Dempsey | 264/282 |
| 3,597,814 | 8/1971 | Trifunovic | 26/18.6 |
| 3,810,280 | 5/1974 | Walton et al. | 26/18.6 |
| 3,869,768 | 3/1975 | Walton et al. | 26/18.6 |
| 4,090,385 | 5/1978 | Packard | 72/191 |
| 4,118,841 | 10/1978 | Diggle, Jr. | 26/18.6 |
| 4,142,278 | 3/1979 | Walton et al. | 26/18.6 |
| 4,192,709 | 3/1980 | Dunlap | 162/111 |
| 4,206,528 | 6/1980 | Klemz | 15/267.51 |
| 4,432,927 | 2/1984 | Van Tillburg et al. | 26/18.6 |
| 4,717,329 | 1/1988 | Packard et al. | 425/328 |
| 5,060,349 | 10/1991 | Walton et al. | 26/18.6 |
| 5,230,775 | 7/1993 | Goodnow et al. | 162/281 |
| 5,417,762 | 5/1995 | Sieberth | 162/281 |

FOREIGN PATENT DOCUMENTS 2 265 917 10/1993 United Kingdom .

OTHER PUBLICATIONS

Supplementary European Search Report dated Feb. 2, 1997.

*Primary Examiner*—Amy B. Vanatta
*Attorney, Agent, or Firm*—Fish & Richardson, P.C.

[57] ABSTRACT

Apparatus for longitudinal compressive treatment of a continuous web of material, comprising a cylindrical drive roll (100), a sheet form assembly (112, 114) to engage and press the web against the drive roll, and a sheet holder (200) for positioning the sheet assembly over the drive roll. A configuration stands from one face of the sheet assembly, the sheet holder defines a channel (21) transverse to the direction of motion of the web, the cannel being open at one of tis ends for insertion of the assembly endwise into the sheet holder by sliding motion in the transverse direction, and the channel is engageable with the standing configuration to retain and position the sheet assembly int eh longitudinal direction. This holding arrangement provides for simple installation, while accomodating thermal expansion and contraction of the sheet assembly during operation.

28 Claims, 9 Drawing Sheets

APPARATUS FOR COMPRESSIVELY TREATING FLEXIBLE SHEET MATERIALS

BACKGROUND OF THE INVENTION

The invention relates to the longitudinal compressive treatment of webs in which a web is driven forward by being pressed against a drive roll by a sheet-form primary member. A stationary retarding surface or surfaces act to retard the driven web to cause the web to slow and longitudinally compact or crepe in a treatment zone. This technique, sometimes referred to as microcreping because of its ability to produce fine crepes, is exemplified by our prior U.S. Pat. Nos. 3,810,280, 4,142,278 and 5,060,349, which are incorporated herein by reference.

Among the prior art for mounting primary and retarder members in a microcreper is the apparatus disclosed in U.S. Pat. No. 4,717,329. While having advantages in many circumstances, this mounting has drawbacks in the personnel time required in changing the primary and retarder members and in limitations of machine designs possible when employing such a clamp. It would be desirable to have a mounting which avoided such drawbacks, but which still enabled the primary and retarder members to expand and contract with change in temperature without disturbing the geometry of the treatment zone.

SUMMARY OF THE INVENTION

In general, the invention features an apparatus for longitudinal compressive treatment of a continuous web of material, comprising a cylindrical drive roll, a primary sheet-form member in an assembly to engage and press the web against the drive roll, and a sheet holder for positioning the sheet-form member over the drive roll, so that the sheet extends from the sheet holder in the direction of travel of the web. In a first aspect of the invention, a configuration stands from one face of the sheet assembly, this configuration extending transverse to the direction of travel of the web, the sheet holder defines a holding channel transverse to the direction of motion of the web, the channel being open at one of its ends for insertion of the assembly endwise into the sheet holder by sliding motion in the transverse direction, and the channel is engageable with the standing configuration to retain and position the sheet assembly in the longitudinal direction.

Preferred embodiments include the following features. The standing configuration comprises fasteners which are preferably screws and nuts whose heads protrude from the surface of the sheet assembly. The top and bottom surface of the channel each has a groove transverse to the direction of travel of the web, configured to receive, retain, and position the fasteners. The channel is flared at the open end to facilitate mounting of the sheet assembly.

In preferred embodiments the sheet assembly includes a sheet-form retarding member exposed to engage the face of the web downstream beyond the primary member. In certain preferred embodiments the retarding member defines a rough retarding surface for engagement with the web before the web leaves the drive roll while in other preferred embodiments the retarding member is a smooth-surfaced, flexible retarder.

In a second aspect, the invention provides a replaceable, preassembled pressing and retarding sheet unit for use in an apparatus for longitudinal compressive treatment of a continuous web of material. The apparatus includes a cylindrical drive roll for advancing the web and a sheet holder configured to operatively press the sheet assembly unit against the web thereby to compress the web between the preassembled sheet unit and the drive roll. The preassembled sheet unit includes a smooth-surfaced sheet-form primary member configured to be disposed over the drive roll to press the web into driven engagement with the drive roll, sheet-form retarder means joined downstream to the primary member to be in engagement with the web to retard motion imparted by the drive roll to the web, and a configuration securely affixed to and standing from a face of the preassembled sheet unit. The standing configuration mates with a complementary feature of the sheet holder to position the preassembled sheet unit operatively over the drive roll with the preassembled sheet unit extending from the sheet holder in the direction of travel of the web, thereby to retain the preassembled sheet unit against movement in the direction of travel of the web away from the sheet holder. The sheet-form members and the standing configuration are assembled and joined together to allow the preassembled sheet unit to be handled as a unit by an operator of the apparatus.

Preferred embodiments may include the following features. The preassembled sheet unit is fastened together by screws and nuts, with the standing configuration being the heads of the screws and nuts. The shanks of the screws have an unthreaded shoulder configured to engage the sheet-form members of the sheet package with a minimum of play. The preassembled sheet unit includes a sheet member held into the sheet package by an adhesive, for instance by adhesive tape.

Among the advantages of microcrepers according to the invention are the following. The sheet assembly can be removed and replaced quickly by a single operator by an endwise sliding motion into the holding channel. The sheet assembly is free to expand and contract in the lateral direction, avoiding thermal distortion effects. The sheet-form members of the assembly are not vulnerable to tearing at their mounting points. When multiple sheets are employed, they are fastened to each other as a package, the resulting assembly as a whole being fairly stiff and easy for the operator to handle. The sheet assembly and holder are simple and durable, with fasteners that secure sheet members together as a unit serving the added function of accurate positioning despite thermal expansion movement. Taping together the sheet members allows cost-reduced manufacturing compared to other methods that require stamped holes or slots, and allows adjustment of the relative positions of the sheet members. Because access to the front of the machine is not required in order to replace sheets of the assembly, other machine components of the treatment line, for instance an exit ramp, can more easily be maintained adjacent to the microcreper outlet.

Other advantages and features of the invention will become apparent from the following description of a preferred embodiment, and from the claims.

DESCRIPTION OF A PREFERRED EMBODIMENT

Figure 1:
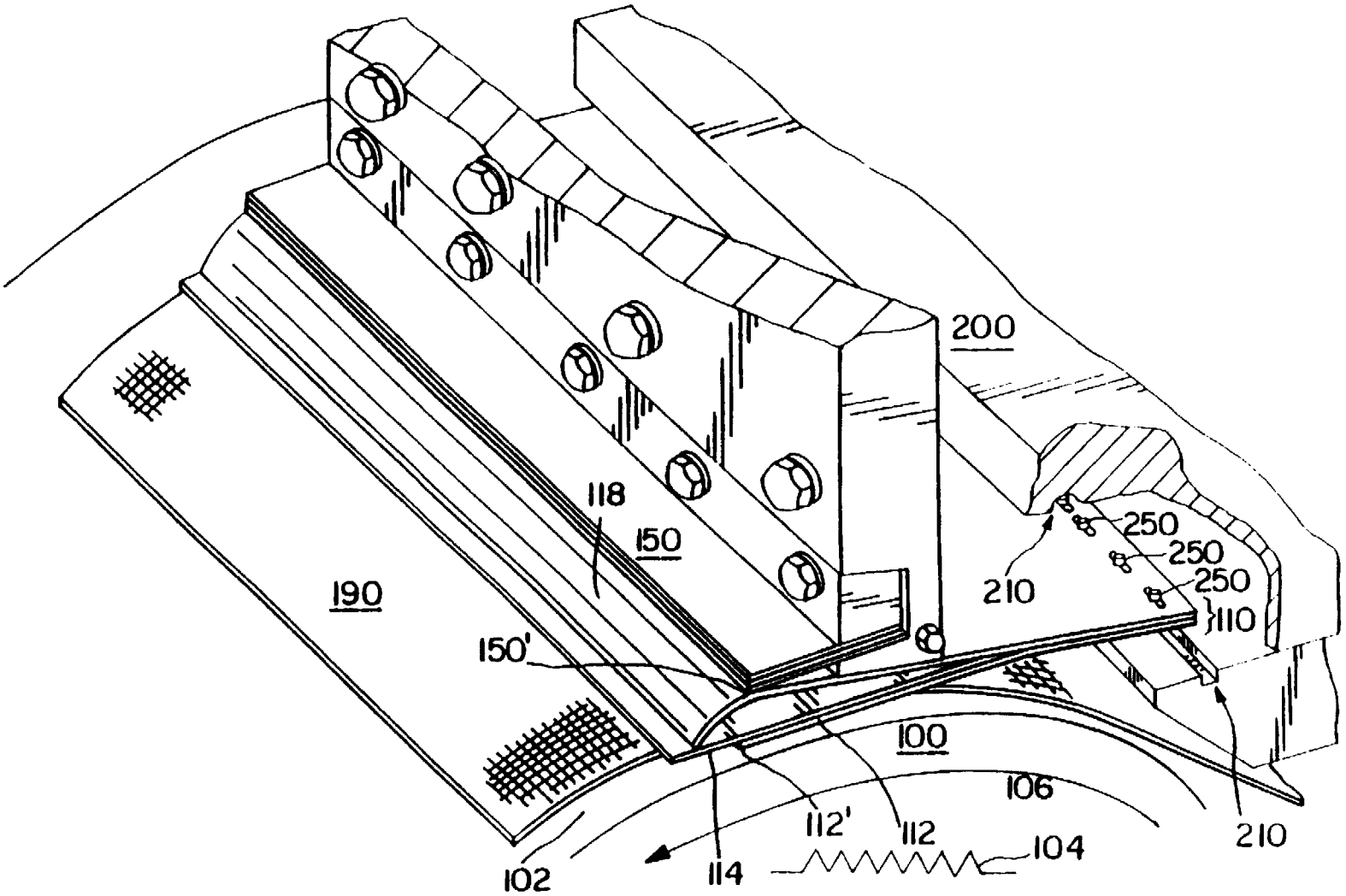
FIG. 1 is a perspective view of a so-called bladeless microcreper.

FIG. 1 shows a microcreper according to the invention. A cylindrical drive roll 100 rotates in direction 106 to advance a web of material 190 past feeding shoe surface 112 and retarding surface 114. The roll is typically steel, and has a web-gripping surface 102 roughened by fine carbide particles applied by plasma coating. The roll, of e.g. 12-inch diameter, contains thermostatically-controlled internal heaters, denoted schematically by 104. The feeding and retarding surfaces are provided as an assembly of sheet-form members mounted in a sheet holder 200 and extending forward. The assembly passes under presser member 150 and over roll surface 102 where it engages the outer surface of web 190 on the roll. The sheet members of the sheet assembly 110 are joined together by a row of fasteners 250 at the upstream edge of the sheet assembly. The sheet holder 200 is provided with a channel 210 transverse to the direction of motion 106 of the web.

Figure 1A:
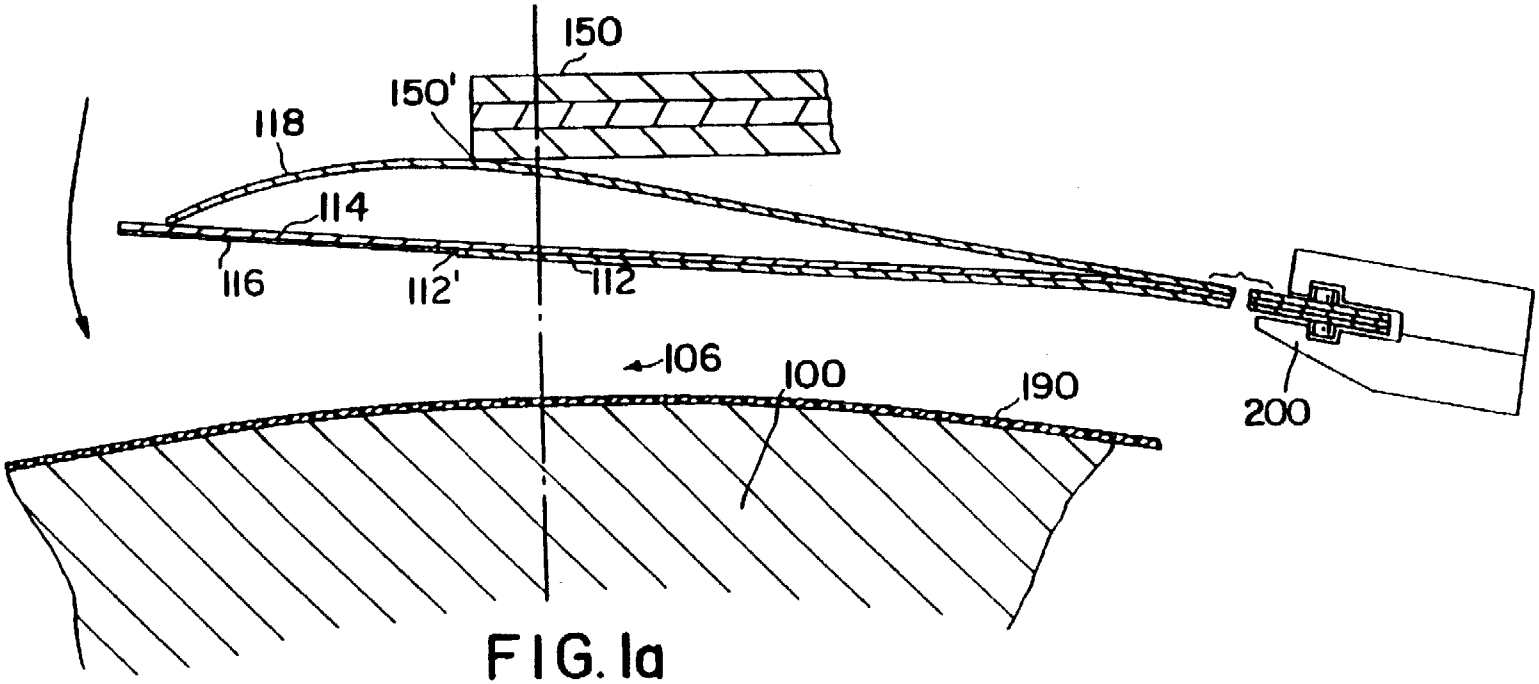
FIGS. 1*a*–1*c* are sectional views of the microcreper.

Referring to FIG. 1*a*, from the bottom up, the assembly consists of a primary feeding member 112 (which may comprise one or a superposed set of sheet-form members), one or more retarder members 114 which support a retarding surface 116, and a conformer member 118 specially curved to apply force to the tip portion of the sheet assembly. Typically, each of feeding primary 112, retarding 114, and conformer members 118 are formed of sheets of blue spring steel. Feeding primary member 112 has a smooth undersurface and is arranged, by the influence of presser member edge 150', to press web 190 into driven engagement with the surface 102 of drive roll 100. The downstream edge 112' of primary member 112 lies slightly downstream from alignment with presser member edge 150'. The sheet-form members are positioned by sheet holder 200, with the free end of the pre-curved conformer member 118 engaged upon the retarder member 114 near the free tip of the latter. To reach the operative condition, the head, comprising the presser member 150, the holder 200 and the sheet assembly 110, are rotated as a unit by pneumatic actuators, not shown, to the operative position of FIGS. 1*b* and 1*c*.

Figure 1B:
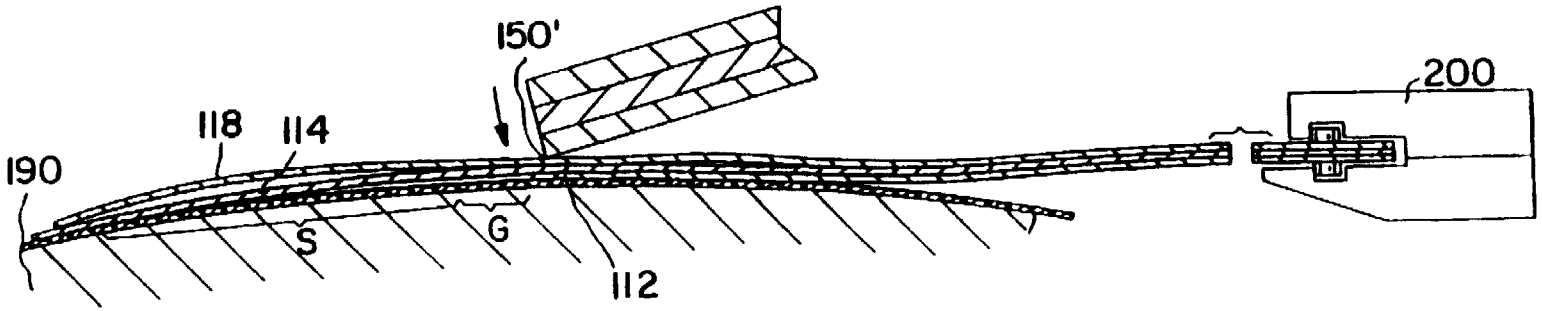
Figure 1C:
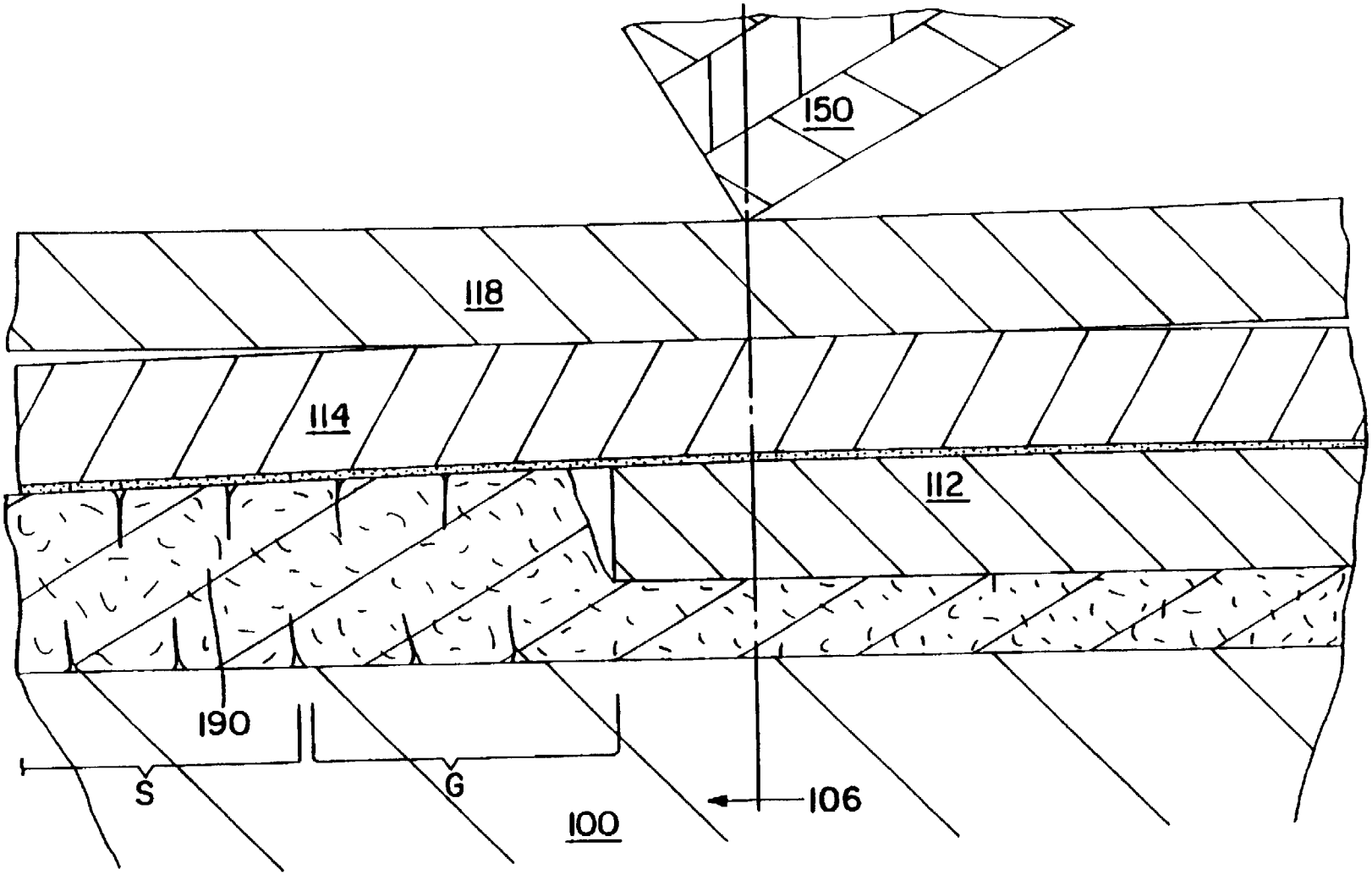

FIG. 1*b* and the magnified view of FIG. 1*c* show a microcreper in operative position. Pressure member 150 forces each of the sheet members, particularly primary member 112, into engagement with web 190 against roll 100. The retarder member 114 is bowed to conform to the roll, as a result of pressure applied to its tip region by the cantilevered end of conformer member 118.

Figure 2:
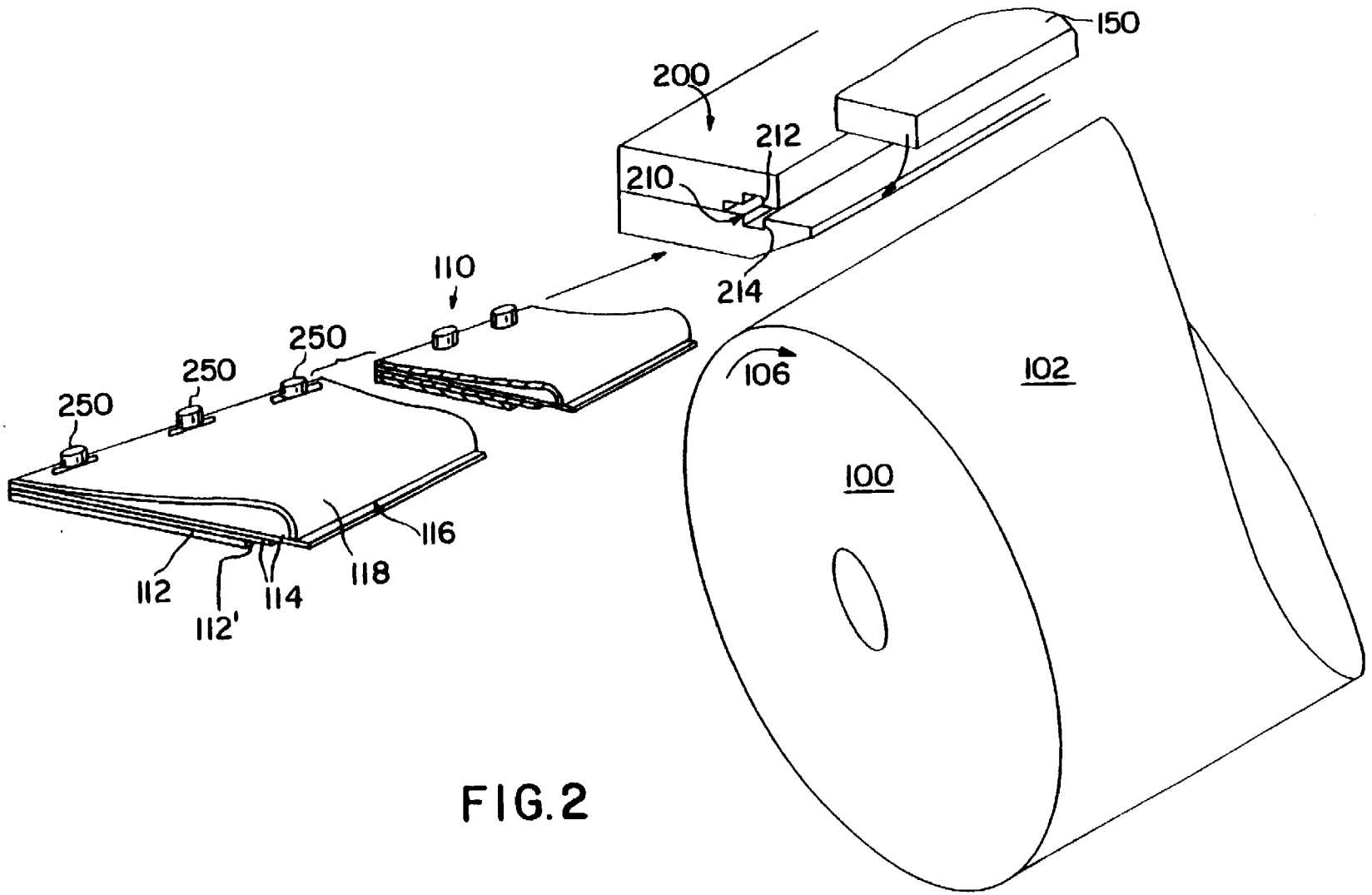
FIG. 2 is a perspective view of a sheet assembly and sheet holder.

Referring to FIG. 2, the sheet members of the sheet assembly 110 are joined together by a row of fasteners 250 at the upstream edge of the sheet assembly. The sheet holder 200 is provided with a channel 210 transverse to the direction of motion 106 of the web. The channel has a reference surface 212, 214 configured to engage the heads of the fasteners and thereby retain and position the sheet assembly.

Figure 2A:
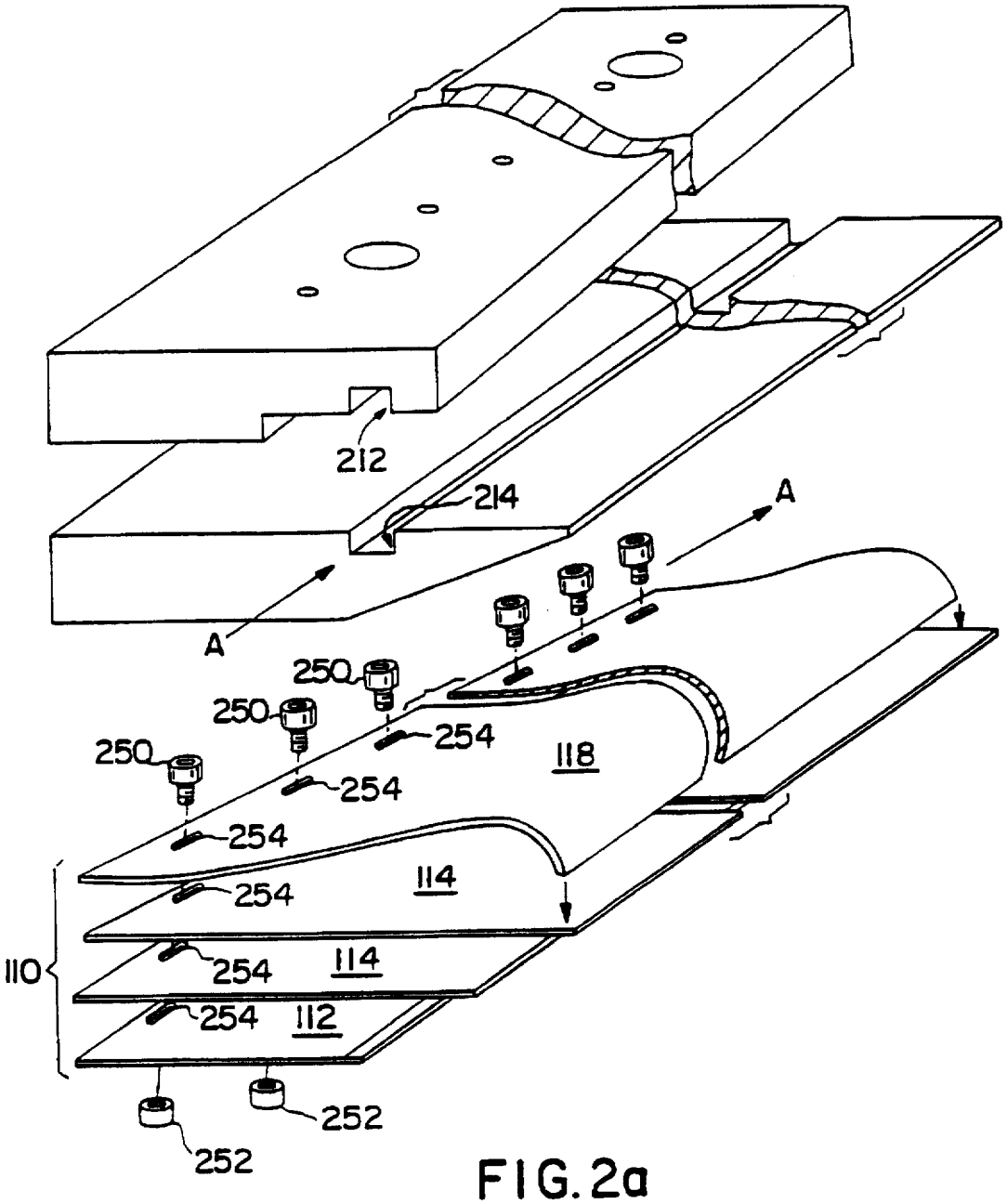
FIG. 2*a* is an exploded view of a sheet assembly and sheet holder.

Referring to FIG. 2*a*, in one embodiment, the sheet holder is formed in two components: the upper component is machined from a 1¼×3¼" steel bar, and the lower from 1×3¾" bar. Viewed from above, the two components are each substantially rectangular, with holes for mounting and positioning, and a groove which will be shown and discussed in detail in connection with FIG. 2*d*. The sheet assembly comprises a primary member 112, one or more retarder members 114, and a conformer member 118. The sheet members are held together by cylindrical-head Allen screws 250 threaded into cylindrical nuts 252. Each sheet member has a row of oval holes 254 on 5" centers along the margin adjacent the upstream edge.

Figure 2B:
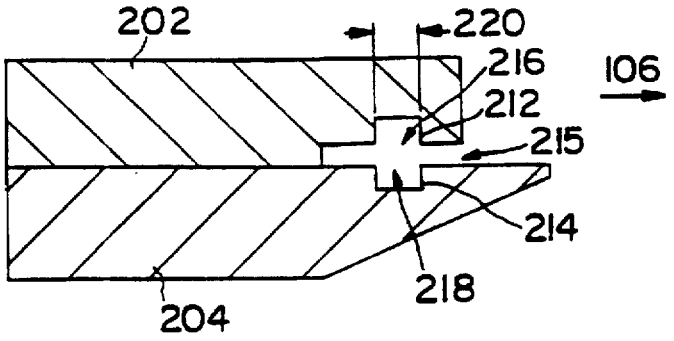
FIG. 2*b* is a sectional view of a sheet holder.

Referring to FIG. 2*b*, milled into the two sheet holder components are grooves 216, 218 with reference surfaces 212, 214; these reference surfaces are straight to within 0.005". Together, the two components define a T-shaped channel. The base 215 of the T opens in the web's direction of travel 106 and is wide enough to accommodate the thickest sheet assembly contemplated for use in the microcreper.

Figure 2C:
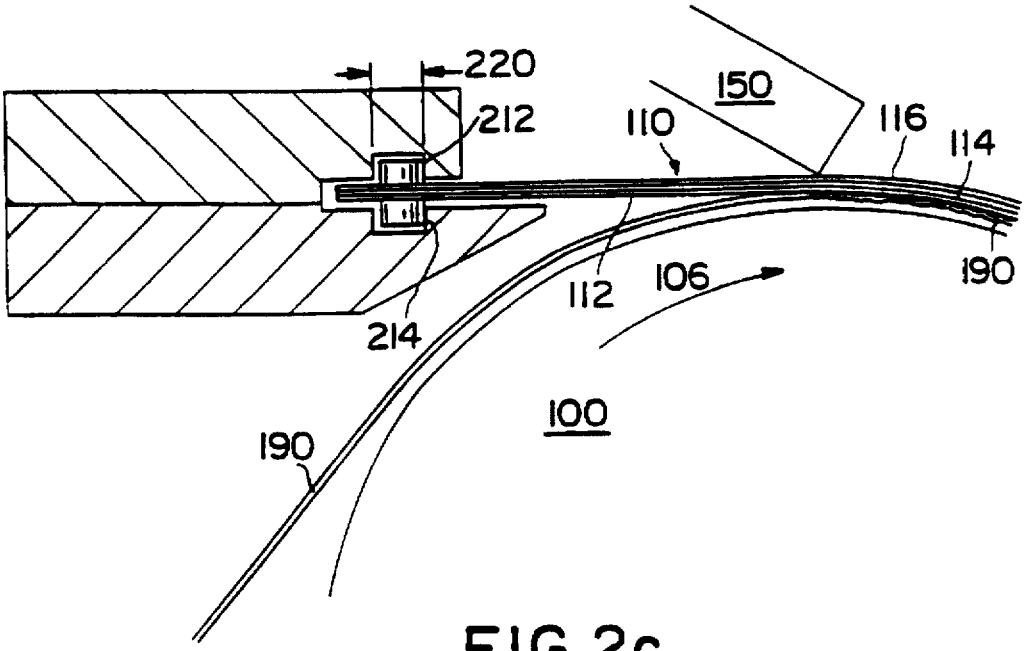
FIG. 2*c* is a sectional view of a microcreper.

Referring to FIG. 2*c*, the heads of the Allen screws and nuts hold the sheet assembly in the sheet holder. The dimension 220 of the grooves in the direction of travel 106 of the web may be somewhat larger than the dimension of the heads of the fasteners; the drag of the web against the undersurface 116 of the sheet assembly tends to urge the sheet assembly in the direction of travel of the web, indicated by the arrow 106. This keeps the heads of the Allen screws and nuts in firm engagement with the reference surfaces 212, 214, thus maintaining precise positioning of the sheet assembly 110. Because the heads can slide within the channel, the assembly 110 is free to expand and contract in the transverse direction.

Referring again to FIG. 2, the channel extends to the end of the sheet holder. Thus, a single operator can change the sheet assembly by sliding the old one out and the new one into the sheet holder from the side.

Figure 2D:
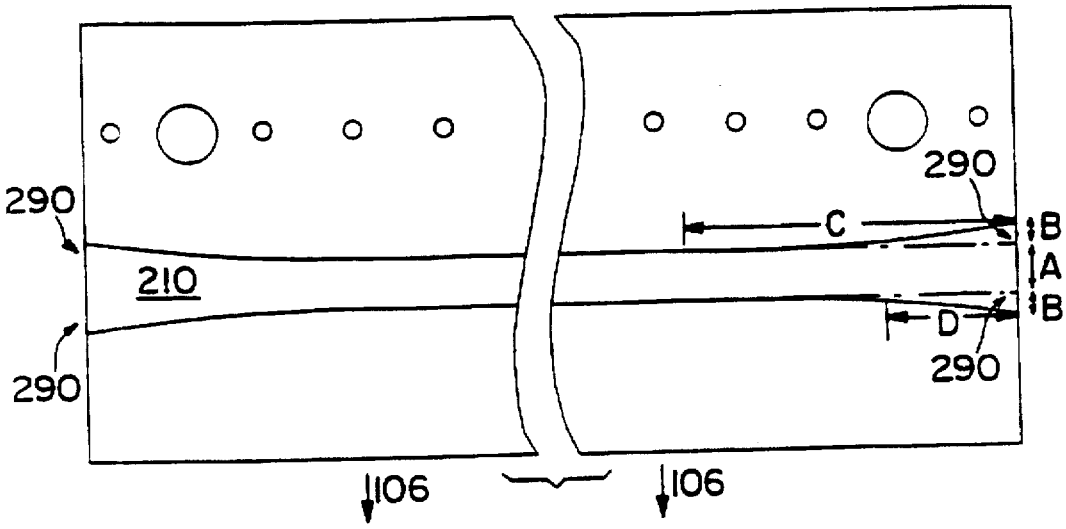
FIG. 2*d* is a plan view of one component of the sheet holder.

FIG. 2*d* is a top plan view of the lower piece of the sheet holder; the direction of travel 106 of the web is in the direction of the arrow 106. The ends of the channel 210 are flared to ease insertion of the sheet assembly. Because the front reference surface is substantially flat to properly position the sheet assembly, the flaring is achieved mostly by removing metal from the back surface of the channel. The nominal width of the channel, dimension A, is about 0.325", and the flare (both front and rear, dimension B) is about 0.12". This flare is accomplished within about 2" (dimension D) on the front surface, and about 10" (dimension C) on the back surface.

Figure 2E:
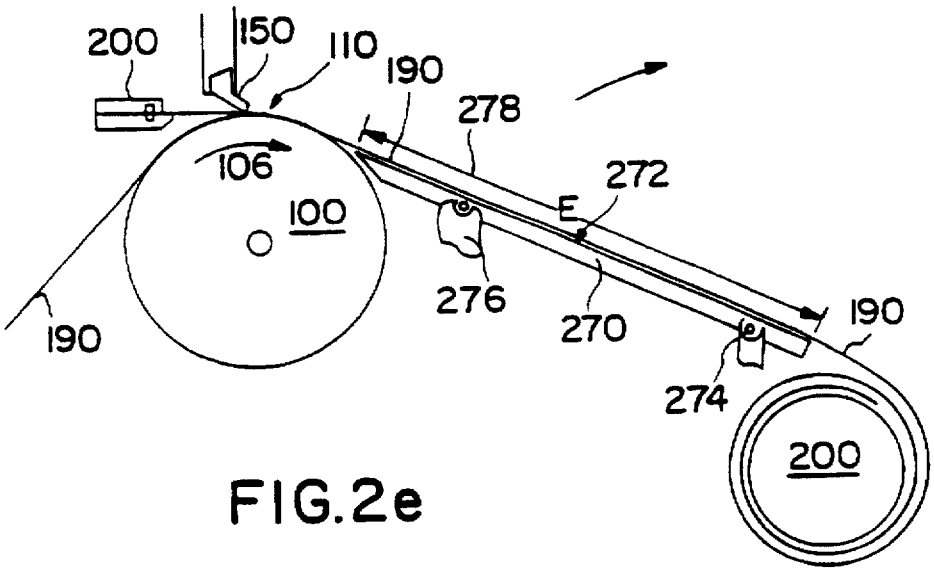
FIG. 2*e* is a side plan view of the microcreper.

Referring to FIG. 2*e*, a further advantage of the side-loading sheet holder is that it allows another machine component to be positioned immediately downstream of the microcreper roll, without requiring space for operator access to the holder to replace sheets from the front of the microcreper. Such devices might include a batcher, e.g., a folder or a winder 280, and an exit ramp 270 immediately adjacent the roll. The exit ramp supports the web while it is being wound, reducing the tension on the web especially when it is still hot from the treatment process, allowing the web to cool and dry, thereby reducing pulling out of the crepe. The exit ramp is a ⅛ aluminum sheet, preferably about 30" long (dimension E) and of width about equal to the width of the drive roll 100, with a slippery surface 272, e.g. teflon tape, and is supported by an appropriate frame mounted on a pivot 274 and bracket 276 so that it can be pivoted up (direction 278) for access to the front of the microcreper.

Figure 3:
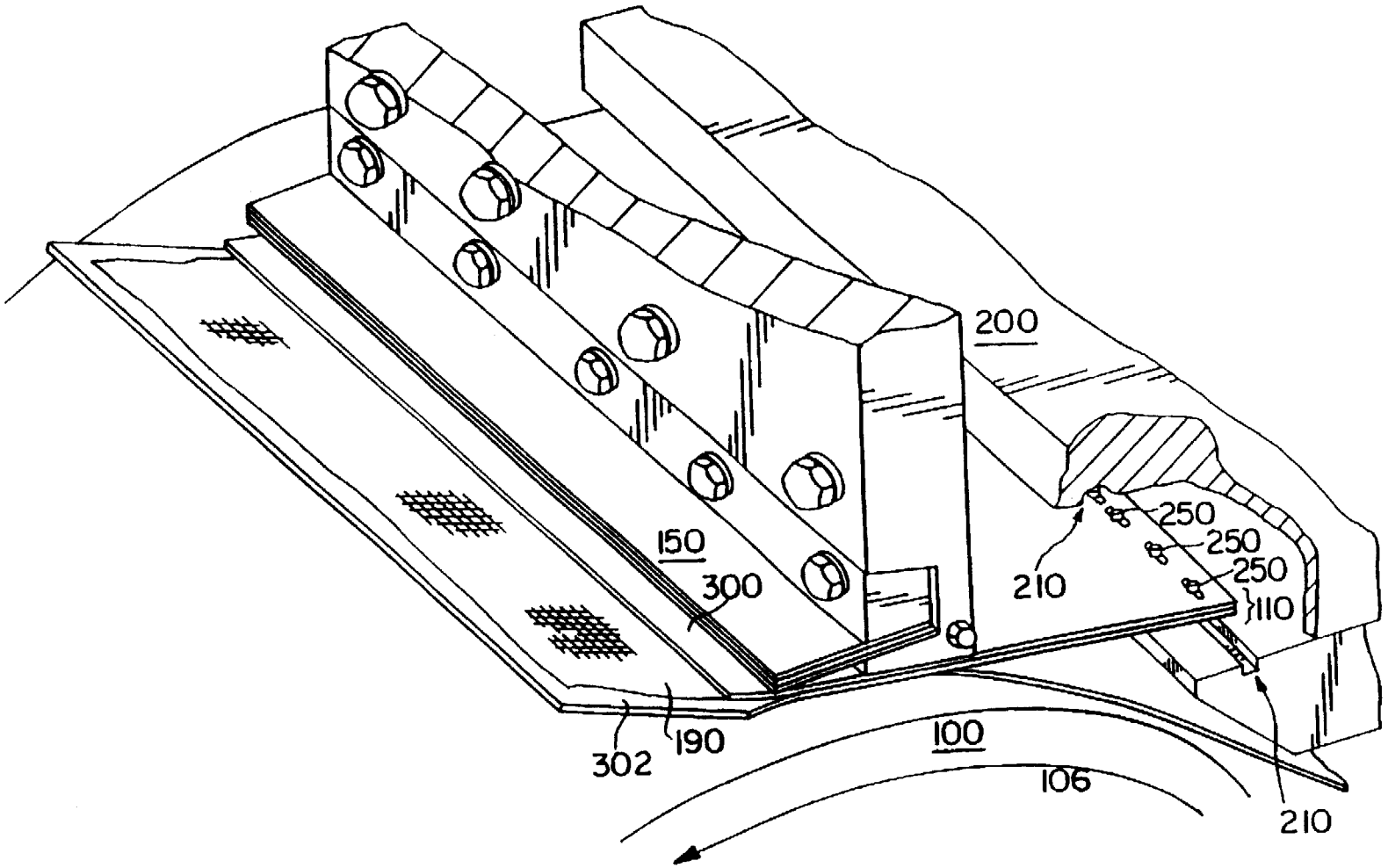
FIG. 3 is a view similar to FIG. 1 of a microcreper that has a lower retarding blade.

The embodiment of FIG. 3 is the same as that of FIG. 1 in respect of the holder channel. In this case a sheet assembly unit (or "package") incorporates a primary member and a smooth-surfaced flexible retarder 300. A stationary, lower retarder blade 302 is held adjacent the roll and engages the driven side of the web as it leaves the roll while the flexible retarder engages the opposite side of the web. The primary member and flexible retarder sheet unit can be installed and replaced in the manner described for the previously described embodiment.

Figure 4B:
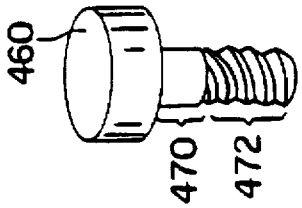
FIG. 4*b* is a perspective view of a screw.
Figure 4C:
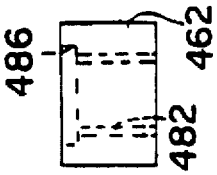
FIG. 4*c* is a side view of a nut.
Figure 4A:
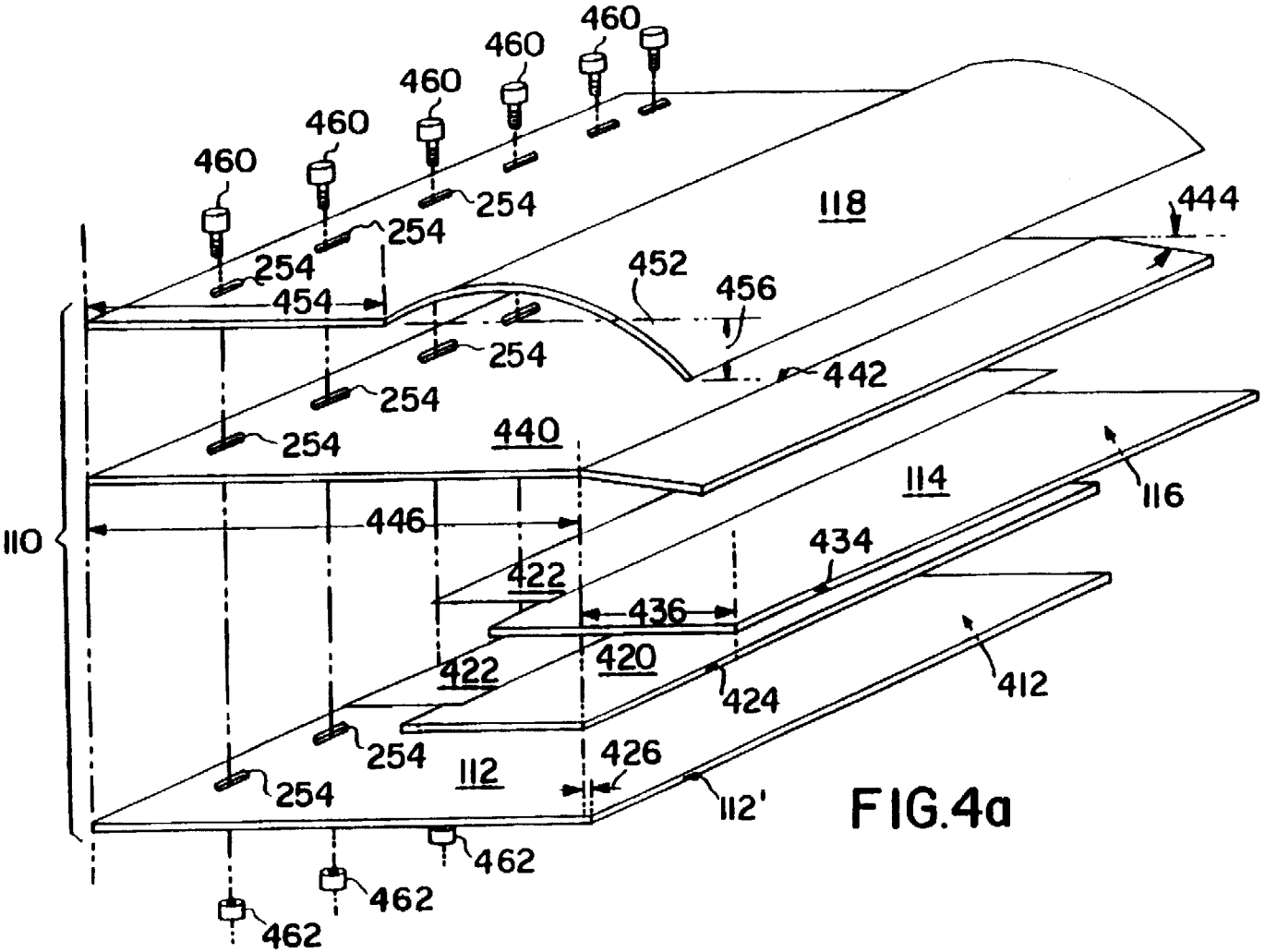
FIG. 4*a* is an exploded view of a sheet assembly.

FIG. 4*a* shows an embodiment of a five-member sheet assembly 110 well-suited for treatment of interlock-knit and jersey knit fabrics. Primary member 112 is formed of 0.006–0.010" thick×4.06"×70.0" sheet steel. Undersurface 412 is teflon coated. The next member 420 is formed of 0.003" thick×1.5"×70.0" sheet steel, and is taped to primary member 112 with high-temperature tape (part number #8401 from Minnesota Mining and Manufacturing), with free edge 424 0.06" (dimension 426) recessed behind the free edge 112' of primary member 112. Retarder sheet 114 is formed of 0.010–0.012" thick×2.0"×70.0" sheet steel, and is taped to primary member 112 with free edge 434 1.25" (dimension 436) downstream from edge 424. Undersurface 116 of retarder sheet 114 is roughened, for instance with a large number of parallel ridges and grooves biased at 30° to the direction of drive of the web. The ridges are 0.010" wide and the grooves are 0.040" wide and 0.005–0.007" deep. Retarder surface 116 may alternately be plasma-coated with tungsten carbide to a roll surface 100–120 RMS. If the plasma coating is combined with the ridges, the plasma may be sanded or stoned off the lands of the ridges. Fourth member 440 is formed of 0.012" thick×5.0"×70.0" sheet steel, and has a flat bend 442 of 7° (dimension 444) four inches from the back edge (dimension 446). Conformer member 118 is formed of 0.012" thick×5.0"×70.0" sheet steel, and has a 3.0"-radius curve 452 formed starting 2.38" from the back edge (dimension 454) and ending about 0.5" below (dimension 456) the straight portion.

Three of sheet members 112, 440, 118 are screwed together with ¼ #10–32 screws 460 and nuts 462 through slots 254. Slots 254 are each 0.20"×0.5" on 5" centers. One of screws 460 is shown in detail in FIG. 4*b*. The shank of screw 460 has a raised shoulder portion 470 of outer diameter 0.195" and length 0.060", and a threaded portion 472 with #10–32 threads. The total shank length is about ¼. The outer diameter of shoulder 470 is larger than the major diameter of threaded portion 472, so that the 0.20" slots 254 have relatively little play relative to shoulder 470. Referring to FIG. 4*c*, each nut 462 has a countersunk portion 480 before #10–32 female threads 482 to accommodate shoulder portion 470 when screws 460 and nuts 462 are used to hold together a sheet assembly with fewer sheets. The heads of both screw 460 and nut 462 are about 0.315" in diameter, so that they can be inserted through sheet assembly 110 in either direction.

In other embodiments the sheet assembly may comprise one or a set of superposed sheet members that support the primary surface, without a retarder member being included in the assembly.

Other embodiments are within the following claims. For example, an angle iron could be added to the sheet assembly, and also held by the fasteners or some other protuberance could be provided on the sheet assembly unit. Such protuberances, rather than the heads of the fasteners, could engage the reference surface of the channel of the sheet holder to retain the sheet assembly in position.

What is claimed is:

1. An apparatus for driving and longitudinally compressively treating a continuous web of material, the apparatus comprising:

a cylindrical drive roll having a gripping surface for advancing the web in response to face-wise pressure of the web against the roll, a smooth-surfaced sheet-form primary member arranged over the drive roll to press the web face-wise into driven engagement with the drive roll, a generally-stationary retarder means downstream of said primary member to engage and retard the web, said retarder means comprising a sheet-form member, the primary member and said sheet-form retarder member comprising a sheet assembly of superposed sheet members extending across the width of said web on said drive roll, and a sheet holder for positioning said sheet assembly in operative position over said drive roll with said sheet assembly extending from said sheet holder in the direction of travel of said web so that said primary member presses said web face-wise against said drive roll, said sheet assembly having a transversely extending row of fasteners extending through holes through said sheet-form members at a held margin of said sheet assembly to form a sheet assembly unit, said fasteners having heads protruding from the surface of said sheet assembly, said sheet holder defining a channel transverse to the direction of travel of said web for engagement with said margin, said channel having a flared open end for endwise insertion of said sheet assembly into said sheet holder by sliding motion in said transverse direction, a top and bottom surface of said channel each having a groove transverse to the direction of travel of said web, at least one of said grooves configured to receive, retain, and position said fastener heads, and including a reference surface to engage said fastener heads to precisely position said sheet assembly unit in the longitudinal direction relative to said drive roll and retain said sheet assembly against movement in the direction away from said sheet holder.

2. An apparatus for driving and longitudinally compressively treating a continuous web of material, the apparatus comprising:

a cylindrical drive roll having a gripping surface for advancing the web in response to face-wise pressure of the web against the roll, a sheet assembly comprising a smooth-surfaced sheet-form primary member arranged over the drive roll to press the web face-wise into driven engagement with the drive roll, and a generally-stationary sheet-form retarder means downstream of said primary member to engage and retard the web, a sheet holder for positioning said sheet assembly in operative position over said drive roll with said sheet-form primary member extending from said sheet holder in the direction of travel of said web so that it presses said web face-wise against said drive roll, said sheet assembly having a configuration securely affixed to and standing from one face of the assembly, said standing configuration extending transverse to the direction of travel of said web, said sheet holder defining a channel transverse to the direction of travel of said web for engagement with said sheet assembly, said channel being open at one of its ends for endwise insertion of said sheet assembly, including said standing configuration that is securely affixed to said assembly, into said sheet holder by sliding motion in said transverse direction, said sheet holder having a reference surface engageable with said standing configuration of said assembly to precisely determine the position of said sheet assembly in the longitudinal direction relative to said drive roll and retain said sheet assembly against movement in the direction away from said sheet holder.

3. The apparatus of claim 2 wherein said sheet assembly comprises a plurality of sheet-form members assembled as a unit.

4. The apparatus of claim 3 wherein said sheet assembly unit is fastened together by screws and nuts, said standing configuration being the heads of said screws and nuts, a top and bottom surface of said channel each having a groove transverse to the direction of travel of said web, each of said grooves configured to receive, retain, and position said heads.

5. The apparatus of claim 4 wherein each said head is circular about the axis of the respective screw and nut.

6. The apparatus of claim 4 wherein the shanks of said screws have an unthreaded shoulder configured to engage the sheet-form members of said sheet assembly unit with a minimum of play.

7. The apparatus of claim 4 wherein said sheet assembly further comprises a sheet member held into said sheet assembly unit by an adhesive.

8. The apparatus of claim 3 wherein said sheet assembly further comprises a sheet member held into said sheet assembly unit by an adhesive.

9. The apparatus of claim 8 wherein said adhesive is an adhesive tape.

10. The apparatus of claim 2 wherein said retarding member defines a rough retarding surface for engagement with the web before the web leaves the drive roll.

11. The apparatus of claim 2 wherein said retarding member is a smooth-surfaced, flexible retarder.

12. The apparatus of claim 2 wherein said channel is flared at said open end to facilitate mounting of said sheet assembly.

13. The apparatus of claim 2 wherein said channel has an inner dimension in the direction of travel of said web larger than the outer dimension of said sheet assembly measured at said standing configuration in the direction of travel of said web.

14. The apparatus of claim 2 wherein said channel has a dimension, measured in the direction of travel of said web, offering clearance in excess of the dimension, measured in the direction of travel of said web, of said standing configuration, and said sheet assembly being adapted to be retained in position by an urging force in the direction of travel of said web imparted against said sheet assembly by the traveling web.

15. The apparatus of claim 2 further comprising an exit ramp configured to support said web after said treatment, said ramp positioned downstream of said drive roll and adjacent thereto.

16. The apparatus of claim 2 wherein:

said sheet assembly has configurations securely affixed to and standing from both faces of the assembly, said standing configurations extending transverse to the direction of travel of said web, and said sheet holder having means engageable with both said standing configurations of said assembly to retain and position said sheet assembly in the longitudinal direction.

17. A method for treating a web employing the apparatus of claim 2 including changing a said sheet assembly by:

removing a first said sheet assembly from the sheet holder by sliding endwise the first sheet assembly in a direction transverse to the direction of travel of the web;

inserting endwise a second said sheet assembly endwise into said sheet holder in a sliding motion in said transverse direction, including positioning said second sheet assembly within said sheet holder so that engaging means of the sheet holder engage said second standing configuration to position said sheet assembly in the longitudinal direction and retain said sheet assembly against movement in the direction of travel of said web.

18. The method of claim 17 wherein said sheet assemblies are each fastened together by screws and nuts, said standing configurations being the heads of said screws and nuts, a top and bottom surface of said channel each having a groove transverse to the direction of travel of said web, each of said grooves configured to receive, retain, and position said heads.

19. The method of claim 18 wherein each said head is circular about the axis of the respective screw and nut.

20. The method of claim 17 wherein said channel is flared at said open end to facilitate inserting of said second sheet assembly.

21. A replaceable, preassembled pressing and retarding sheet unit fur use in an apparatus for longitudinal compressive treatment of a continuous web of material, the apparatus comprising a cylindrical drive roll for advancing the web and a sheet holder configured to operatively press said sheet unit against the web thereby to compress the web between said preassembled sheet unit and the drive roll, said preassembled sheet unit comprising:

a smooth-surfaced sheet-form primary member configured to be disposed over the drive roll to press the web into driven engagement with the drive roll;

sheet-form retarder means joined to said primary member and extending downstream of said primary member for engagement with the web to retard motion imparted to the web by the interaction of said primary member and said drive roll; and a configuration securely affixed to and standing from a face of said preassmbled sheet unit and configured to mate with a complementary feature of the sheet holder, said standing configuration being arranged to position said preassembled sheet unit operatively over the drive roll with said preassembled sheet unit extending from the sheet holder in the direction of travel of the web and to retain said preassembled sheet unit against movement in the direction of travel of the web away from the sheet holder;

said sheet-form primary member, said sheet-form retarding means, and said standing configuration being assembled and joined together to allow said preassembled sheet unit to be handled as a unit by an operator of the apparatus.

22. The preassembled sheet unit of claim 21 wherein sheets of said preassembled sheet unit are fastened together by screw and nut assemblies, said standing configuration being heads of said screw and nut assemblies.

23. The preassembled sheet unit of claim 22 wherein each said head is circular about the axis of the respective screw and nut assemblies.

24. The preassembled sheet unit of claim 22 wherein the shanks of said screws have an unthreaded shoulder configured to engage the sheet-form members of said preassembled sheet unit with a minimum of play.

25. The preassembled sheet unit of claim 22 wherein said preassembled sheet unit further comprises a sheet member held to said preassembled sheet unit by an adhesive.

26. The preassembled sheet unit of claim 21 wherein said preassembled sheet unit further comprises a sheet member held to said preassembled sheet unit by an adhesive.

27. The preassembled sheet unit of claim 26 wherein said adhesive is an adhesive tape.

28. The preassembled sheet unit of claim 21 wherein:

said preassembled sheet unit has configurations securely affixed to and standing from both faces of said preassembled sheet unit, said standing configurations extending transverse to the direction of travel of the web and engageable with grooves in the sheet holder extending transverse to the direction of travel of the web.

* * * * *